US006186103B1

(12) United States Patent
Schäfer et al.

(10) Patent No.: US 6,186,103 B1
(45) Date of Patent: Feb. 13, 2001

(54) DEVICE FOR VARYING TIMING OF GAS EXCHANGE VALVES OF INTERNAL COMBUSTION ENGINES, PARTICULARLY A VANE-TYPE CAMSHAFT ADJUSTING DEVICE

(75) Inventors: Jens Schäfer, Herzogenaurach; Manfred Schindler, Markt Schwaben, both of (DE)

(73) Assignee: Ina Walzlager Schaeffler oHG (DE)

( * ) Notice: Under 35 U.S.C. 154(b), the term of this patent shall be extended for 0 days.

(21) Appl. No.: 09/348,065

(22) Filed: Jul. 6, 1999

(30) Foreign Application Priority Data

Jul. 6, 1998 (DE) ..... 198 30 100

(51) Int. Cl.[7] ..... F01L 1/34
(52) U.S. Cl. ..... 123/90.17; 123/90.37
(58) Field of Search ..... 123/90.17, 90.37, 123/90.15, 90.31, 90.34

(56) References Cited

U.S. PATENT DOCUMENTS

| | | | | |
|---|---|---|---|---|
| 5,860,397 | * | 1/1999 | Schafer | 123/90.15 |
| 5,865,150 | * | 2/1999 | Kramer et al. | 123/90.17 |
| 5,875,750 | * | 3/1999 | Iwassaki et al. | 123/90.17 |
| 6,032,626 | * | 3/2000 | Haag | 123/90.17 |

FOREIGN PATENT DOCUMENTS

| | | |
|---|---|---|
| 3922962 | 1/1991 | (DE) . |
| 0799976 | 10/1997 | (EP) . |

* cited by examiner

*Primary Examiner*—Teresa Walberg
*Assistant Examiner*—Vinod D. Patel
(74) *Attorney, Agent, or Firm*—Bierman, Muserlian and Lucas

(57) ABSTRACT

A vane-type camshaft adjusting device for an internal combustion engine, with a drive pinion (2) connected in driving relationship to a crankshaft, and a winged wheel (7) connected rotationally fast to a camshaft. The drive pinion (2) a hollow space (6) which is defined by a circumferential wall (3) and two side walls (4, 5), into which hollow space (6) is inserted the winged wheel (7) having at least two wings (9) on its wheel hub (8). Limiting walls (10) define at least two working chambers (14) in the hollow space (6) of the drive pinion (2), and each of these working chambers (14) is divided into two hydraulic pressure chambers (18, 19) by one of the wings (9) of the winged wheel (7). The limiting walls (10) of the drive pinion (2) are in sealing contact by axial sealing strips (13) with the wheel hub (8) of the winged wheel (7), while the wings (9) of the winged wheel (7) are in sealing contact by axial sealing strips (17) with the circumferential wall (3) of the drive pinion (2). According to the invention, the sealing strips (13) of the limiting walls (10) of the drive pinion (2) and/or the sealing strips (17) of the wings (9) of the winged wheel (7) are connected to one another to form a one-piece or a multi-piece sealing cage (24, 26, 34) by which the hydraulic pressure chambers (18, 19) in the hollow space (6) of the drive pinion (2) are sealed from one another both radially on the circumferential wall (3) of the drive pinion (2) and/or on the wheel hub (8) of the winged wheel (7) as also axially on the side walls (4, 5) of the drive pinion (2).

12 Claims, 5 Drawing Sheets

DEVICE FOR VARYING TIMING OF GAS EXCHANGE VALVES OF INTERNAL COMBUSTION ENGINES, PARTICULARLY A VANE-TYPE CAMSHAFT ADJUSTING DEVICE

FIELD OF THE INVENTION

The invention concerns a device for varying valve timing of gas exchange valves of an internal combustion engine, particularly a vane-type camshaft adjusting device comprising:

a drive pinion configured as an outer rotor and connected in driving relationship to a crankshaft of the internal combustion engine by a traction means, said drive pinion having a hollow space defined by a circumferential wall and two side walls, a winged wheel configured as an inner rotor and connected rotationally fast to a camshaft of the internal combustion engine, which winged wheel is inserted into the hollow space of the drive pinion and has a wheel hub on whose periphery are radially arranged at least two wings, at least two working chambers defined within the hollow space of the drive pinion by limiting walls extending from an inner surface of the circumferential wall towards a central longitudinal axis of the drive pinion, radial end faces of the limiting walls being in sealing contact with the wheel hub of the winged wheel by sealing strips arranged in axial retaining grooves, each working chamber being divided into two hydraulic pressure chambers by one of the wings of the winged wheel, radial end faces of the wings being in sealing contact in each working chamber with the inner surface of circumferential wall by sealing strips likewise arranged in axial retaining grooves, and a turning and/or fixing of the winged wheel relative to the drive pinion, and thus a relative rotation and/or a continuous hydraulic clamping of the camshaft relative to the crankshaft is obtained by an optional successive or simultaneous pressurizing of the pressure chambers by a hydraulic pressure medium.

BACKGROUND OF THE INVENTION

A generic camshaft adjusting device of the pre-cited type is known from EP 0 799 976 A1 and comprises a drive pinion configured as an outer rotor which is connected in driving relationship to a crankshaft of an internal combustion engine by a traction means, and a winged wheel configured as an inner rotor and connected rotationally fast to a camshaft of the internal combustion engine. The drive pinion comprises a hollow space defined by a circumferential wall and two side walls, into which hollow space is inserted the winged wheel which comprises four radially arranged wings on the periphery of its wheel hub. Four hydraulic working chambers are defined within the hollow space of the drive pinion by four uniformly spaced limiting walls which extend from the inner surface of the circumferential wall toward the central longitudinal axis of the drive pinion. Each of the working chambers is divided into two hydraulic pressure chambers by one of the wings of the winged wheel. The radial end faces of the limiting walls of the drive pinion are in sealed contact with the wheel hub of the winged wheel by sealing strips arranged in axial retaining grooves, while, at the same time, the radial end faces of the wings of the winged wheel are in sealed contact with the inner surface of the circumferential wall of the drive pinion by sealing strips likewise arranged in axial retaining grooves. Thus, by an optional successive or simultaneous pressurizing of the pressure chambers by a hydraulic pressure medium, the winged wheel can be turned and/or fixed relative to the drive pinion to obtain a relative rotation and/or a continuous hydraulic clamping of the camshaft relative to the crankshaft.

A drawback of this prior art device is that, besides the radial sealing of the individual pressure chambers from one another by the sealing strips on the radial end faces of the wings and the limiting walls, no measures are provided for an axial sealing of the pressure chambers of the device from one another. Thus, particularly when manufacturing tolerances in the axial dimension of the drive pinion and the winged wheel add up and produce a relatively large axial play between the winged wheel and the drive pinion, it is possible that internal pressure medium leaks or hydraulic short circuits between the pressure chambers, which always have a detrimental effect on the functioning of the adjusting device, take place through the gaps formed between the wings of the winged wheel and the side walls of the drive pinion. These malfunctions manifest themselves generally in the form of reduced adjusting speeds of the device which are the cause of a delayed response of the device to changing conditions of operation of the internal combustion engine, or in the form of an insufficient hydraulic clamping of the winged wheel in the drive pinion, so that the desired angular position of the camshaft relative to the crankshaft cannot be exactly maintained.

Further, DE-OS 39 22 962 discloses the use of axial sealing strips arranged in radial retaining grooves on the end surfaces of the wings in addition to the radial seals on the end faces of the wings in a camshaft adjusting device likewise comprising a drive pinion with four working chambers and a winged wheel with four wings.

However, such a sealing of the individual pressure chambers of the device has the drawback that it requires a large number of separate sealing strips and thus considerably more assembly work is involved in the manufacturing of the device. Moreover, due to the joint gaps naturally formed between the individual sealing strips, high pressure medium leakage can still occur so that the aforesaid resulting malfunctions of the device are not completely eliminated by such a sealing arrangement.

OBJECTS OF THE INVENTION

It is therefore an object of the invention to create a device for varying the timing of gas exchange valves of an internal combustion engine, particularly a vane-type camshaft adjusting device whose hydraulic pressure chambers are additionally sealed from one another in axial direction without the need of a plurality of separate sealing strips and irrespective of manufacturing tolerances of the axial dimension of the drive pinion and the winged wheel.

It is a further object of the invention to reduce internal pressure medium leakage in the device to a minimum.

These and other objects and advantages of the invention will become obvious from the following detailed description.

SUMMARY OF THE INVENTION

The invention achieves these objects in a device of the pre-cited type by the fact that the sealing strips on the radial end faces of the limiting walls of the drive pinion and/or the sealing strips on the radial end faces of the wings of the winged wheels are joined to each other by radial and coaxial struts along axial end surfaces of the drive pinion and/or along axial end surfaces of the winged wheel to form a one- or a multi-piece sealing cage which enables a sealing of the hydraulic pressure chambers in the hollow space of the drive pinion from one another both radially on the circumferential wall of the drive pinion and/or on the wheel hub of the winged wheel, as also axially on the side walls of the drive pinion, the sealing cage further enabling a compensation of axial manufacturing tolerances between the drive pinion and the winged wheel of the device.

In a first preferred embodiment of the seal of the invention, the pressure chambers in the hollow space of the drive pinion are sealed radially on the circumferential wall of the drive pinion by the sealing strips on the radial end faces of the wings of the winged wheel, and for sealing the pressure chambers radially on the wheel hub of the winged wheel and axially on the side walls of the drive pinion, only the sealing strips on the radial end faces of the limiting walls of the drive pinion are joined to one another to form a one- or a multi-piece sealing cage. Each limiting wall of the drive pinion preferably comprises two sealing strips arranged next to each other in retaining grooves provided on the radial end faces of the limiting walls. Each sealing strip of a limiting wall is joined to a sealing strip of the adjacent limiting wall to form a sealing cage element which seals the pressure chambers of one of the working chambers of the drive pinion axially and radially and can be assembled together with further identical sealing cage elements to form a multi-piece sealing cage. In this embodiment, the number of working chambers in the hollow space of the drive pinion of the device determines the number of sealing cage elements required for complete sealing. Thus, for example, in a device having three working chambers in the hollow space of the drive pinion and three wings on the wheel hub of the winged wheel, the sealing cage is made up of three identical sealing cage elements each of which almost completely surrounds one of the working chambers both radially and axially. However, it is also possible to arrange only one sealing strip in a retaining groove on the radial end face of each limiting wall of the drive pinion and join all these sealing strips on the limiting walls to one another to form a one-piece sealing cage.

A second preferred embodiment of the seal of the invention is a reversal of the first embodiment i.e., the pressure chambers in the hollow space of the drive pinion are sealed radially on the wheel hub of the winged wheel by sealing strips on the radial end faces of the limiting walls of the drive pinion, and for sealing the pressure chambers radially on the circumferential wall of the drive pinion and axially on the side walls of the drive pinion, only the sealing strips on the radial end faces of the wings of the winged wheel are joined together to form a one-piece or a multi-piece sealing cage.

In a first implementation of the second embodiment, the wings of the winged wheels also preferably comprise two sealing strips arranged next to each other in retaining grooves provided on the radial end faces of the wings. Each sealing strip of a wing is joined to a sealing strip of the adjacent wing to form a sealing cage element which seals one pressure chamber of each of two adjacent working chambers of the drive pinion axially and radially and can be assembled together with further identical sealing cage elements to form a multi-piece sealing cage. Thus, similar to the first embodiment, the number of wings on the wheel hub of the winged wheel determines the number of sealing cage elements required for complete sealing. Thus, in a device having, for example, three wings on the wheel hub of the winged wheel and three working chambers in the hollow space of the drive pinion, the sealing cage is composed of three identical sealing cage elements each of which surrounds one pressure chamber of one working chamber and one pressure chamber of the adjacent working chamber axially and radially at least on one side.

For facilitating the mounting of the multi-piece sealing cages of the first and the second embodiment of the invention on the drive pinion or on the winged wheel of the device respectively, the invention further proposes to divide the sealing cage elements preferably into two axially separated sealing segments so that, in a device having three working chambers in the drive pinion and three wings on the winged wheel, the three sealing cage elements are divided into six identical sealing segments which are not only easier to mount but also simpler to manufacture. The free ends of these sealing segments advantageously preferably comprise a flattened extension and are arranged in overlapping relationship in the retaining grooves of the sealing strips on the radial end faces of the limiting walls of the drive pinion or of the wings of the winged wheel, as the case may be.

In a second implementation of the second preferred embodiment of the seal of the invention, the sealing strips on the radial end faces of the wings of the winged wheel are connected by radial struts to annular segments bearing concentrically against the wheel hub on the two axial end surfaces of the winged wheel so that a sealing cage is formed which is preferably divided into two axially separated sealing cage elements and simultaneously seals all the pressure chambers of the working chambers of the drive pinion axially and radially from one another in pairs. Therefore, irrespective of the number of wings on the wheel hub of the winged wheel, or of the number of working chambers in the drive pinion, the sealing cage of this embodiment of the invention is always made up of two identical sealing cage elements. The number of radial struts from the sealing strips to the annular segments of the sealing cage which bear against the wheel hub, however, is determined by the number of wings of the winged wheel if only one sealing strip is arranged on the radial end face of each wing of the winged wheel. It is, however, also possible, even in this embodiment, to arrange two sealing strips next to each other in retaining grooves in the radial end face of each wing of the winged wheel and to connect these sealing strips by separate or common radial struts to the annular segments to form the sealing cage.

Finally, a third preferred embodiment of the seal of the invention is a combination of the first and the second embodiment. In this third embodiment, the limiting walls of the drive pinion again comprise on their radial end faces preferably two sealing strips arranged next to each other in retaining grooves, and each sealing strip of a limiting wall is connected to a sealing strip of an adjacent limiting wall to form a sealing cage element which, together with further identical sealing cage elements forms a first multi-piece sealing cage. At the same time, a second sealing cage is formed in that each sealing strip on the radial end faces of the wings of the winged wheel is connected by radial struts to annular segments bearing concentrically against the wheel hub on both axial end surfaces of the winged wheel. This cage is also preferably divided into two axially separated sealing cage elements. Thus, the sealing strips on the radial end faces of the limiting walls of the drive pinion and the sealing strips on the radial end faces of the wings of the winged wheel are integrated in separate sealing cages and offer an almost optimal sealing of the device against internal pressure medium leakage. For the sealing cage formed from the sealing strips of the limiting walls of the drive pinion, it is again the number of working chambers in the hollow space of the drive pinion that is decisive for the number of sealing cage elements required. Thus, for example, in a device having three working chambers in the hollow space of the drive pinion and three wings on the winged wheel, the sealing cage is again made up of three identical sealing cage elements so that, together with the two sealing cage elements formed from the sealing strips on the wings of the winged wheel, a total of five sealing cage elements are required for sealing the device.

To facilitate mounting, it is possible in this case, too, to additionally divide the sealing cage elements of the sealing cage formed from the sealing strips of the limiting walls of the drive pinion axially into two separate sealing segments. By a cooperation of the two sealing cages on the drive pinion and on the winged wheel of the device, it is then possible to almost completely surround and thus separately seal all the pressure chambers within the device individually both in radial and in axial direction.

With regard to the last-described second and third embodiments of the seal of the invention, it is further proposed that the radial struts of the sealing strips on the radial end faces of the wings of the winged wheel to the annular segments of the sealing cage bearing against the wheel hub of the winged wheel be made preferably arcuate in shape in one peripheral direction with the aim of utilizing the biasing spring force of these radial struts for producing an axial pressing force of the sealing strips on the wings of the winged wheel against the inner surface of the circumferential wall of the drive pinion. It has likewise proved to be advantageous in the case of this sealing cage, which is also preferably divided axially into two sealing cage elements, to provide flattened extensions on the free ends of these sealing cage elements and to arrange these extensions in overlapping relation in the retaining grooves of the sealing strips on the radial end faces of the wings of the winged wheel.

According to a further advantageous feature of the invention, it is further proposed, irrespective of the embodiment of the sealing cage, that every sealing cage of the device be fixable in reception grooves provided in the axial end surfaces of the drive pinion and/or in the axial end surfaces of the winged wheel, which reception grooves open into the retaining grooves of the sealing strips on the radial end faces of the limiting walls of the drive pinion and/or on the radial end faces of the wings of the winged wheel.

Accordingly, in the case of the first embodiment of the seal of the invention, these reception grooves for the individual sealing cage elements start from a retaining groove for a sealing strip on the radial end face of a limiting wall of a working chamber and extend preferably along the end-surface-proximate edge regions of this working chamber, around the working chamber, to the retaining groove of a further sealing strip on the radial end face of the other limiting wall of the working chamber. In the case of the first implementation of the second embodiment of the seal of the invention, in contrast, these reception grooves start from a retaining groove for a sealing strip on the radial end face of a wing of the winged wheel and extend preferably from the end-surface-proximate edge regions of this wing, along the wheel hub of the winged wheel and the end-surface-proximate regions of the next wing of the winged wheel, to the retaining groove of a further sealing strip on the radial end face of this wing.

In the second implementation of the second embodiment, only one annular groove is made in each axial end surface of the wheel hub of the winged wheel and opens via preferably bow-shaped radial connecting grooves on the axial end surfaces of the wings of the winged wheel into the retaining grooves of the sealing strips on the radial end faces of the wings of the winged wheel.

Since, as already described, the third embodiment of the seal of the invention is a combination of the first and the second embodiment, it follows that the reception grooves for the sealing cages of the device are provided in this case both on the axial end surfaces of the drive pinion and on the axial end surfaces of the winged wheel in the aforesaid manner. To avoid high costs for the machining of these reception grooves for the sealing cages and thus also for the manufacture of the device as a whole, it is particularly advantageous to make both the drive pinion and the winged wheel of the device as sintered components.

According to a final proposition of the invention, the sealing cages of the device are made preferably of spring sheet metal having a wavy cross-sectional profile along its longitudinal axis in order to make the cages flexible for mounting and in operation. Such a spring sheet metal cage is advantageously pressed by the pressure of the hydraulic pressure medium both radially and axially against the respective surface of the device to be sealed. However, it is also possible to produce this pressing force by an appropriate shaping of the sealing cage or sealing cage elements themselves and/or by separate spring strips arranged in the retaining and/or reception grooves. As an alternative to this spring sheet metal cage, it is also conceivable to make the cage or cages of the device out of a material which is elastically or plastically deformable under the pressure of the hydraulic pressure medium or during the mounting of the adjusting device and has favorable tribological properties. Examples of such a material are elastomers, teflon strip, copper wire or copper tube.

The device of the invention for varying the valve timing of gas exchange valves of internal combustion engines, particularly a vane-type camshaft adjusting device, thus has the advantage over prior art devices that its hydraulic pressure chambers are sealed both radially and axially from one another by an integration of the hitherto used separate radial and axial sealing strips into one- or multi-piece sealing cages. This results in a considerable reduction of the number of sealing elements required for such a device and in a concomitant reduction of assembly work in the manufacture of the device. Moreover, the sealing cages of the invention also enable a compensation of eventual manufacturing tolerances in the axial dimension of the drive pinion and the winged wheel which cause a relatively large axial play between the winged wheel and the drive pinion. By this compensation, the internal pressure medium leakage and hydraulic short circuits between the pressure chambers of the device which occur due to the gaps formed between the wings of the winged wheel and the side walls of the drive pinion are reduced to a minimum. In this way, detrimental malfunctions of the device in the form of reduced adjusting speeds or insufficient hydraulic clamping of the winged wheel in the drive pinion and the negative effects resulting therefrom for the internal combustion engine can be effectively avoided.

The different embodiments of the invention are described more closely below with reference to the attached drawings.

DETAILED DESCRIPTION OF THE DRAWINGS

Figure 1:
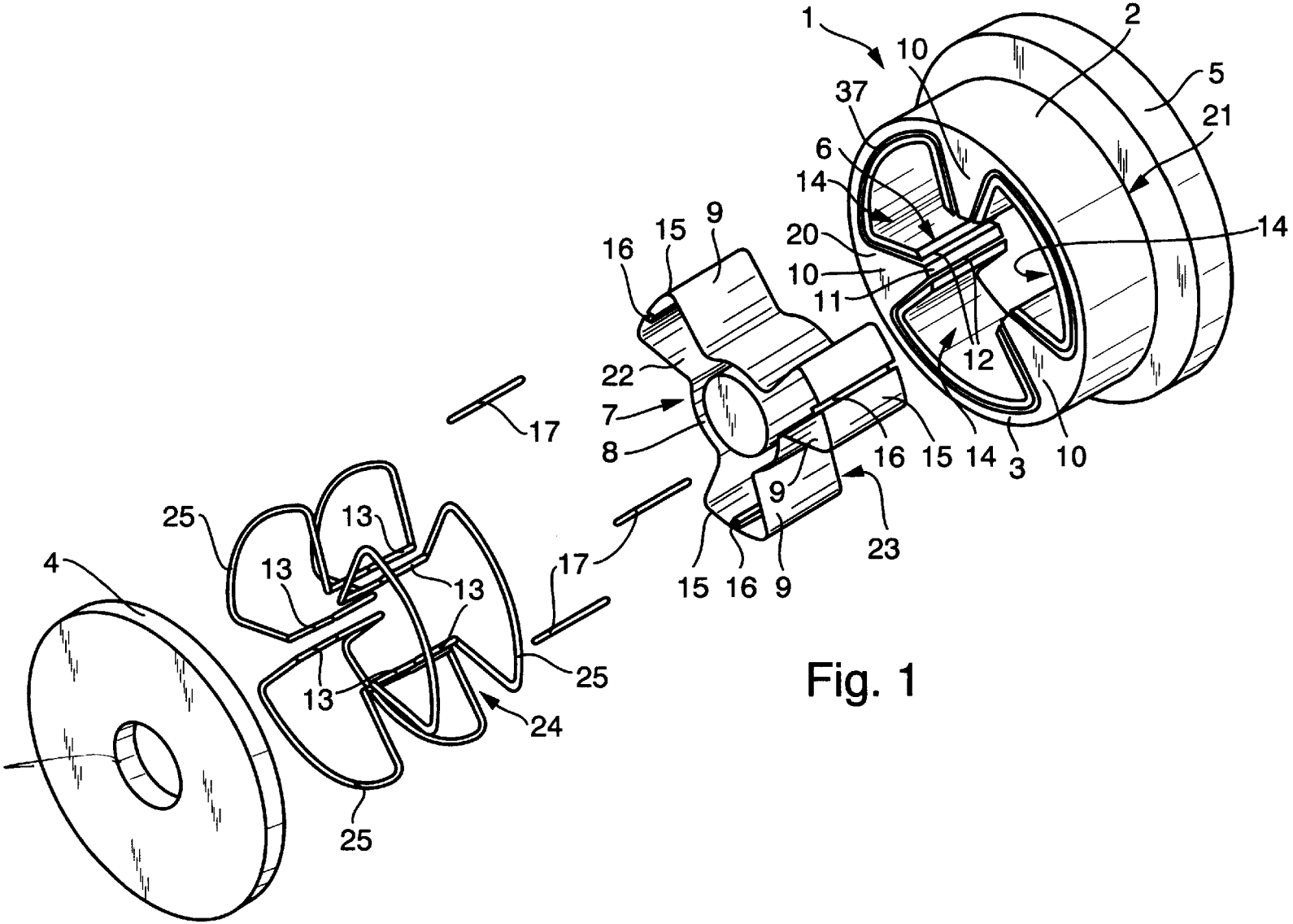
FIG. 1 is a schematic exploded representation of a vane-type camshaft adjusting device equipped with a seal corresponding to the first embodiment of the invention.

FIG. 1 clearly shows the schematically represented individual components of a vane-type camshaft adjusting device, known per se, for varying the valve timing of gas exchange valves of an internal combustion engine. This device 1 consists essentially of a drive pinion 2 which is configured as an outer rotor and connected in driving relationship by a traction means to a crankshaft, not shown, of an internal combustion engine, and a winged wheel 7 which is configured as an inner rotor connected rotationally fast to a camshaft, likewise not shown, of the internal combustion engine.

The drive pinion 2 comprises a hollow space 6 defined by a circumferential wall 3 and two side walls 4, 5, into which hollow space 6 is inserted the winged wheel 7 comprising three wings 9 arranged radially on the periphery of its wheel hub 8. Three limiting walls 10 extending from the inner surface of the circumferential wall 3 towards the central longitudinal axis of the drive pinion 2 define three hydraulic working chambers 14 in the hollow space 6 of the drive pinion 2. As can be seen more clearly in FIG. 2, each of the working chambers 14 is divided into two hydraulic pressure chambers 18, 19 by one of the wings 9 of the winged wheel 7. By an optional successive or simultaneous pressurizing of the pressure chambers 18, 19 with a hydraulic pressure medium, it is possible to cause a pivoting movement and/or fixing of the winged wheel 7 relative to the drive pinion 2 and thus realize a relative rotation and/or a continuous hydraulic clamping of the camshaft relative to the crankshaft.

Figure 2:
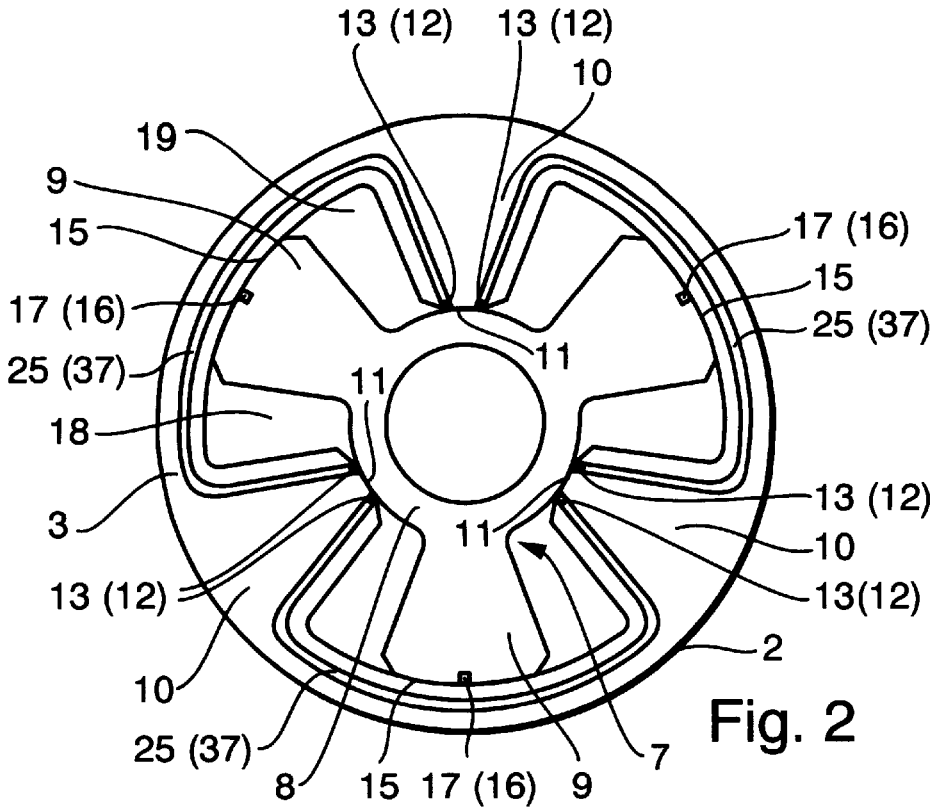
FIG. 2 is a top view of the vane-type camshaft adjusting device of FIG. 1 without side walls, showing the winged wheel and the seal of FIG. 1 in assembled condition.

It can be seen further in FIGS. 1 and 2 that the pressure chambers 18, 19 in the hollow space 6 of the drive pinion 2 are radially sealed from one another on the circumferential wall 3 of the drive pinion 2 in a known manner by sealing strips 17 arranged in axial retaining grooves 16 on the radial end faces 15 of the wings 9 of the winged wheel 7. For sealing the pressure chambers 18, 19 radially relative to the wheel hub 8 of the winged wheel 7 and axially relative to the side walls 4, 5 of the drive pinion 2, in contrast, according to a first embodiment of the invention, the sealing strips 13 likewise arranged in a known manner in axial retaining grooves 12 on the radial end faces 11 of the limiting walls 10 are connected to one another according to the invention by radial and coaxial struts along the axial end surfaces 20, 21 of the drive pinion 2 to form a multi-piece sealing cage 24. With this sealing cage 24, manufacturing tolerances in the axial dimension of the drive pinion 2 and the winged wheel 7 of the device can be compensated. FIGS. 1 and 2 clearly show that each of the limiting walls 10 of the drive pinion 2 comprises on its radial end face 11, two sealing strips 13 arranged next to each other in retaining grooves 12. Each sealing strip 13 of each limiting wall 10 is connected to a sealing strip 13 of the adjacent limiting wall 10 to form a sealing cage element 25 which axially and radially seals the pressure chambers 18, 19 of one of the working chambers 14 of the drive pinion 2. In the present embodiment, this sealing cage element 25 is assembled together with two further identical sealing cage elements 25 to form a three-piece sealing cage 24.

Figure 3:
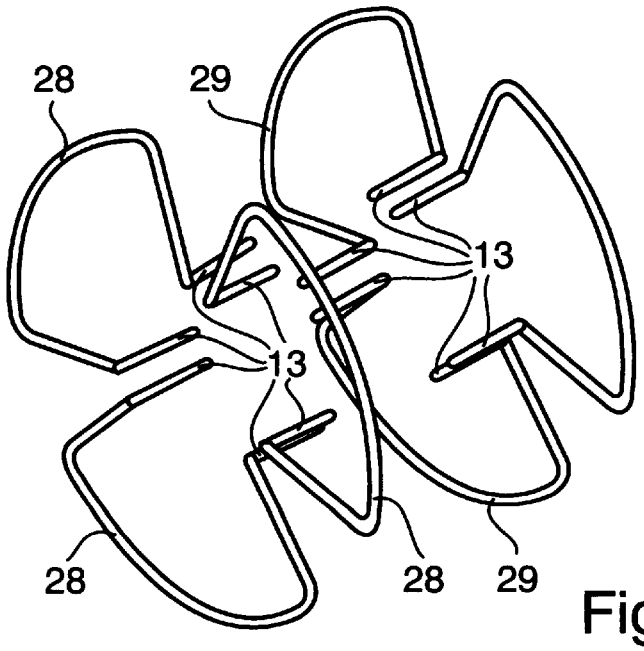
FIG. 3 is an exploded view of a modified sealing cage of the first embodiment of the seal of the invention.

FIG. 3 shows a modification of this embodiment of the sealing cage 24 in which each of the sealing cage elements 25 is divided into two axially separated sealing segments 28, 29 to facilitate mounting on the drive pinion 2. The free ends, not referenced, of the sealing segments 28, 29 comprise slight extensions with which they are arranged in overlapping relationship in the retaining grooves 12 of the sealing strips 13 on the radial end faces 11 of the limiting walls 10 of the drive pinion 2.

In contrast to the first embodiment, the pressure chambers 18, 19 in the hollow space 6 of the drive pinion 2 of the second embodiment shown in FIGS. 4 to 8 are sealed from one another radially on the wheel hub 8 of the winged wheel 7 in a known manner by the sealing strips 13 on the radial end faces 11 of the limiting walls 10 of the drive pinion 2. However, for sealing these pressure chambers 18, 19 radially on the circumferential wall 3 of the drive pinion 2 and axially on the side walls 4, 5 of the drive pinion 2, the sealing strips 17 likewise arranged in a known manner in axial retaining grooves 16 on the radial end faces 15 of the wings 9 of the winged wheel 7 are connected to one another, according to the invention, by radial and coaxial struts on the axial end surfaces 22, 23 of the winged wheel 7 to form a multi-piece cage 26 which can likewise compensate for manufacturing tolerances in the axial dimension of the drive pinion 2 and the winged wheel 7 of the device 1.

Figure 4:
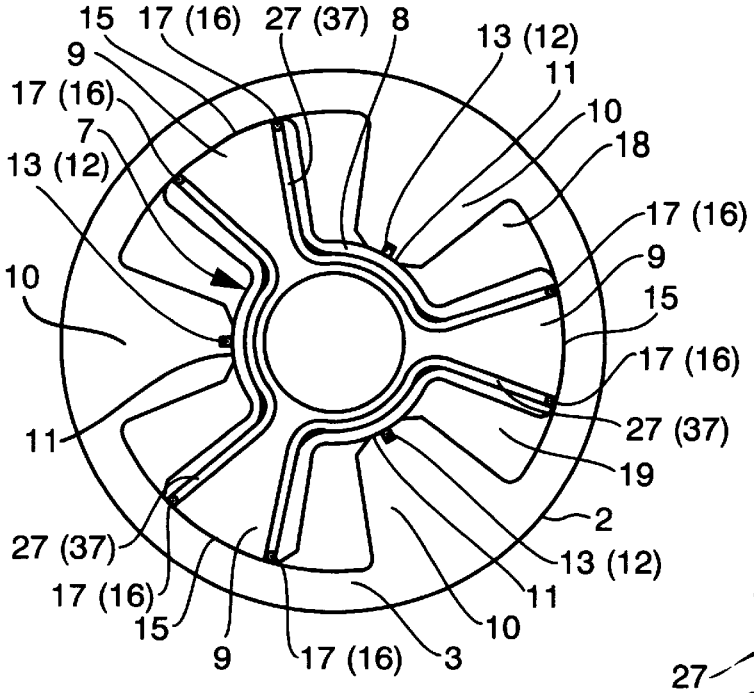
FIG. 4 FIG. 4 is a top view of the vane-type camshaft adjusting device of FIG. 1 without side walls, showing the winged wheel with a first implementation of a second embodiment of the seal of the invention in assembled condition.
Figure 5:
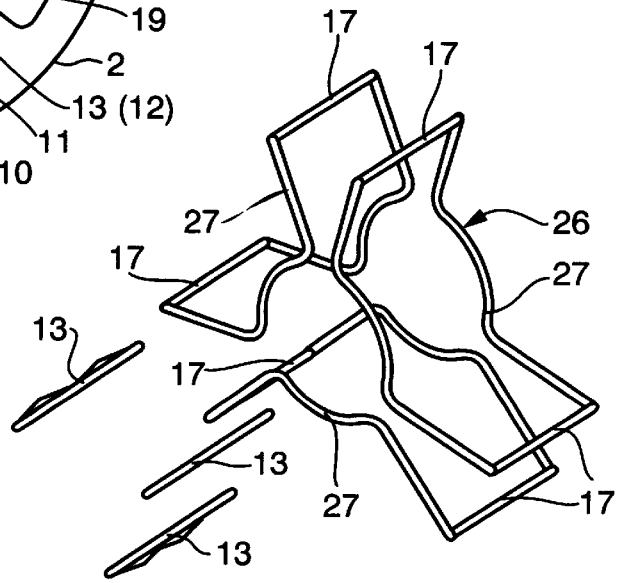
FIG. 5 is an exploded view of the sealing cage of the first implementation of the second embodiment of the seal of the invention shown in FIG. 4.

A first possibility of implementing this second embodiment of the invention is shown in FIGS. 4 and 5. These figures show that each wing 9 of the winged wheel 7 comprises on its radial end face 15 two sealing strips 17 arranged next to each other in retaining grooves 16. Each sealing strip 17 of each wing 9 is connected to a sealing strip 17 of an adjacent wing 9 to form a sealing cage element 27 which axially and radially seals one pressure chamber 18, 19 of each of two adjacent working chambers 14 of the drive pinion 2. In the present case, the sealing cage element 27 is again assembled together with two further identical sealing cage elements 27 to form a three-piece sealing cage 26.

Figure 6:
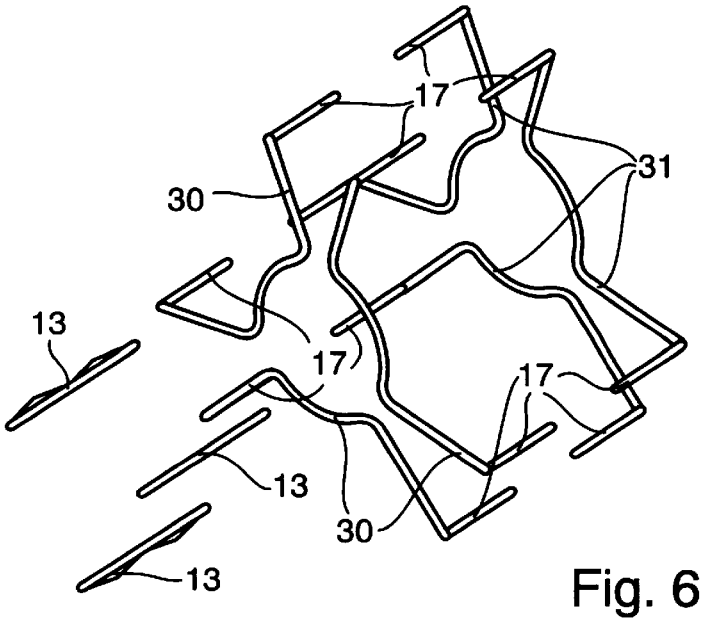
FIG. 6 is an exploded view of a modified sealing cage of the first implementation of the second embodiment of the seal of the invention shown in FIG. 4.

To facilitate mounting, this cage 26, too, as shown in FIG. 6, can be modified by dividing its sealing cage elements 27 into two axially separated sealing segments 30, 31 whose free ends, not referenced, are arranged in overlapping relationship by slight extensions in the retaining grooves 16 of the sealing strips 17 on the radial end faces 15 of the wings 9 of the winged wheel 7.

Figure 7:
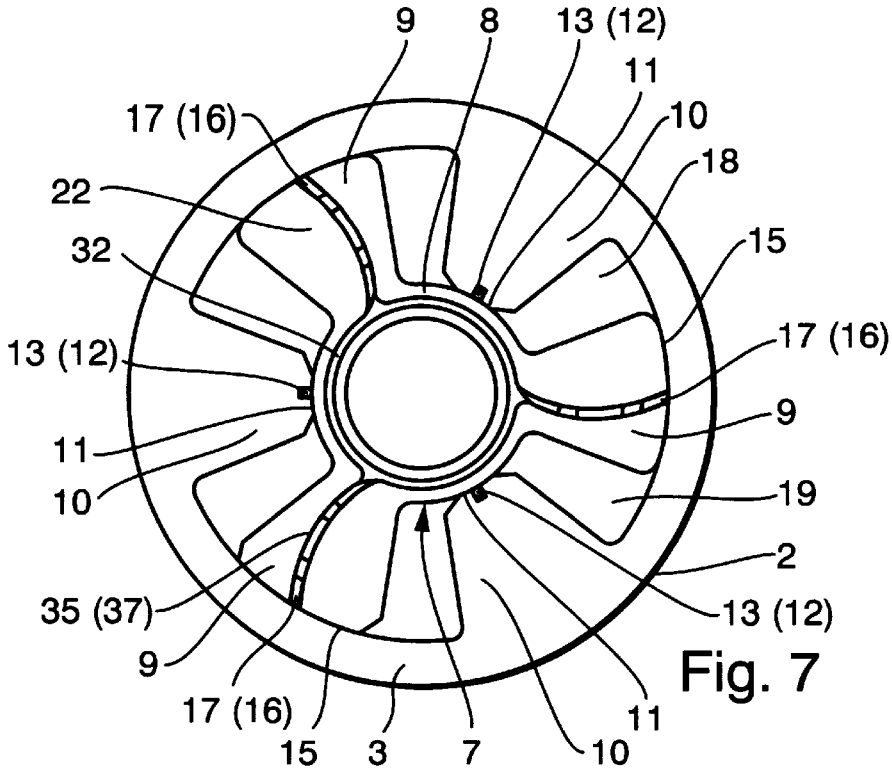
FIG. 7 is a top view of the vane-type camshaft adjusting device of FIG. 1 without side walls, showing the winged wheel with a second implementation of the second embodiment of the seal of the invention in assembled condition.
Figure 8:
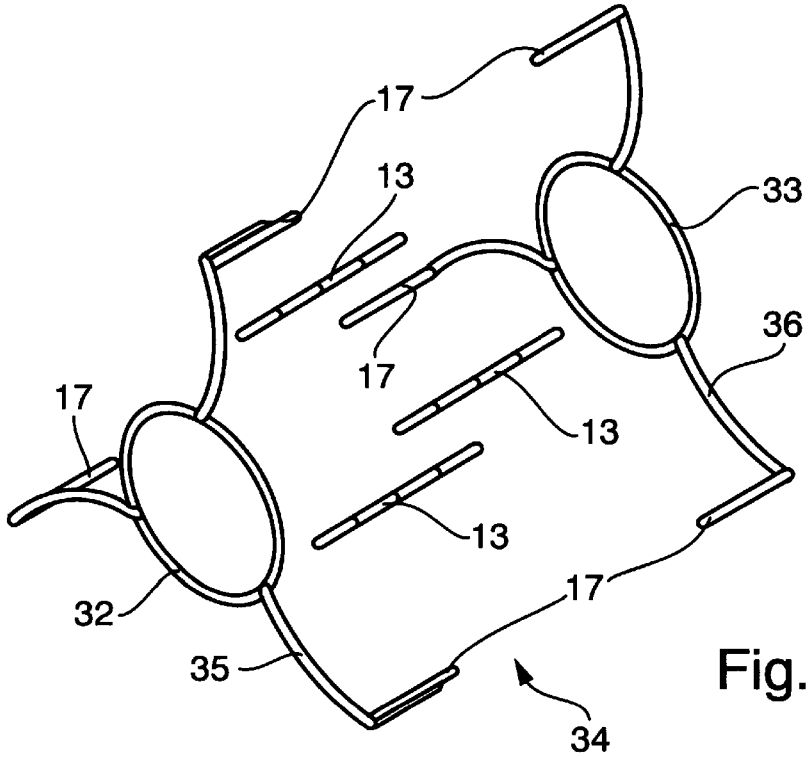
FIG. 8 is an exploded view of the sealing cage of the second implementation of the second embodiment of the seal of the invention shown in FIG. 7.

FIGS. 7 and 8 show a further possibility of implementing the second embodiment of the invention. It can be clearly seen in these figures that each of the wings 9 of the winged wheel 7 has only one sealing strip 17 arranged in a retaining groove 16 on its radial end face 15, and that the sealing strips 17 are connected by radial struts on both axial end surfaces 22, 23 of the winged wheel 7 to annular segments 32, 33 bearing concentrically against the wheel hub 8 so that a sealing cage 34 is formed.

To facilitate mounting, this sealing cage 34, too, as can be seen in FIG. 8, is divided into two axially separated sealing cage elements 35, 36 and simultaneously seals all the pressure chambers 18, 19 of the working chambers 14 axially and radially from one another in pairs. The non-referenced free ends of the sealing cage elements 35, 36 are again arranged in overlapping relationship by slight extensions in the retaining grooves 16 of the sealing strips 17 on the radial end faces 15 of the wings 9 of the winged wheel 7. The struts connecting the sealing strips 17 to the annular segments 32, 33 are bent in a bow shape in one peripheral direction and this serves to produce a pressing force of the sealing strips 17 against the inner surface of the circumferential wall 3 of the drive pinion 2.

Figure 9:
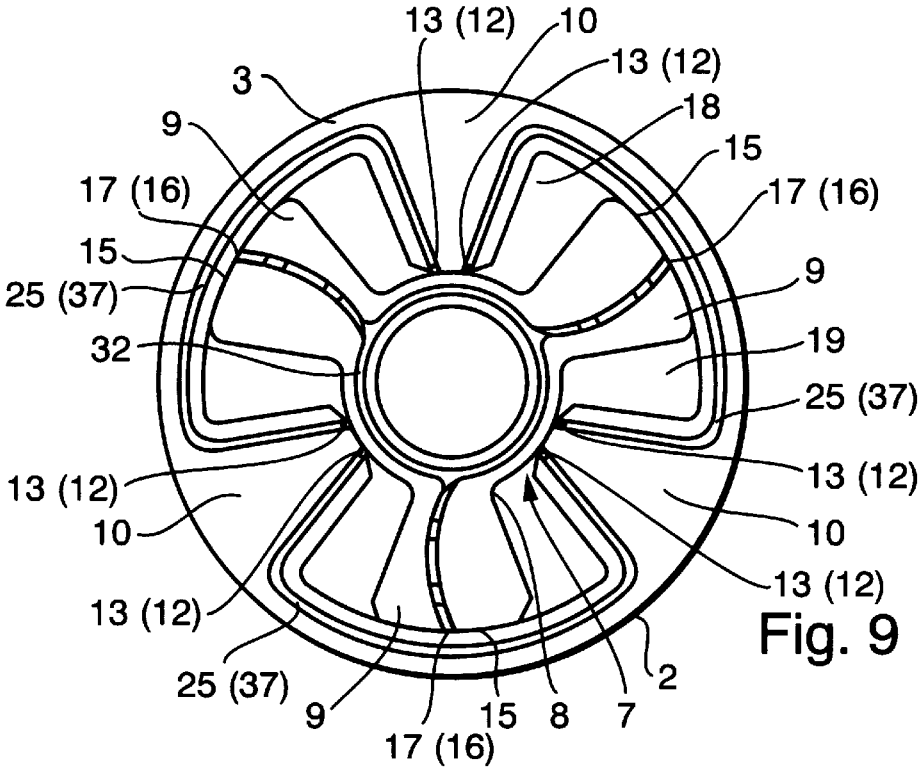
FIG. 9 is a top view of the vane-type camshaft adjusting device of FIG. 1 without side walls, showing the winged wheel with a third embodiment of the seal of the invention in assembled condition.
Figure 10:
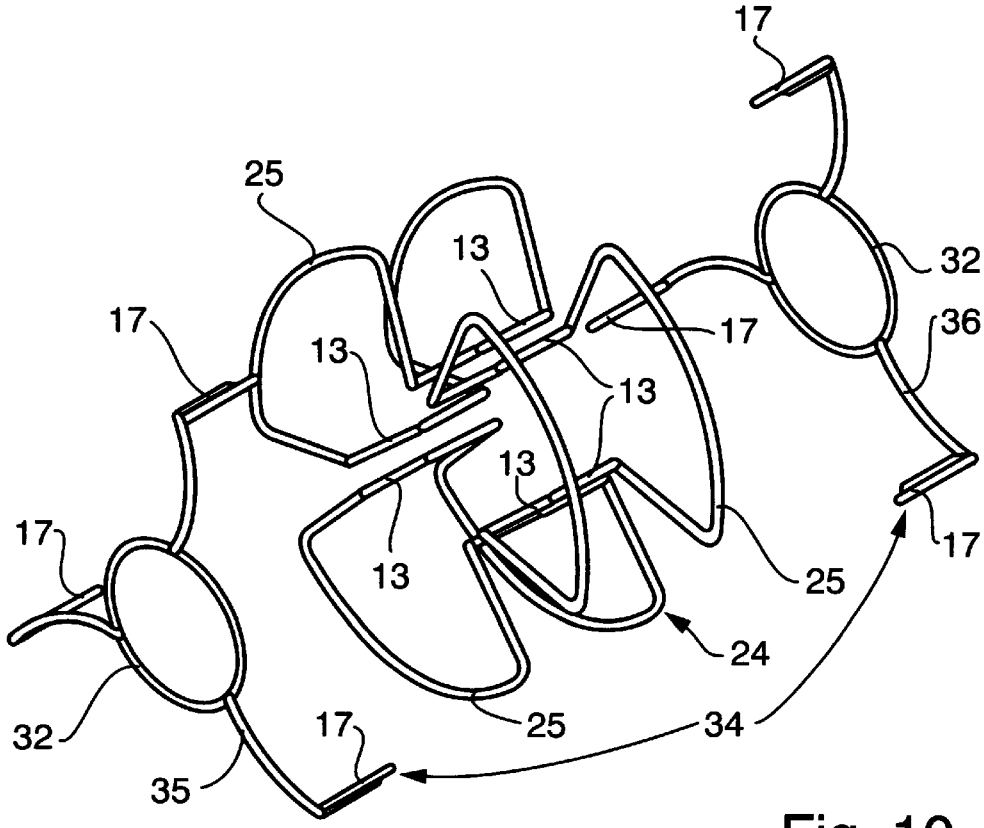
FIG. 10 is an exploded view of the sealing cages of the third embodiment of the seal of the invention shown in FIG. 9.

Finally, a third embodiment of the invention shown in FIGS. 9 and 10 is a combination of the first and the second embodiment of the invention in which the sealing of the hydraulic pressure chambers 18, 19 in the hollow space 6 of the drive pinion 2 both radially on the circumferential wall 3 of the drive pinion 2 and on the wheel hub 8 of the winged wheel 7 as also axially on the side walls 4, 5 of the drive pinion 2 is achieved according to the invention in that the sealing strips 13 on the radial end faces 11 of the limiting walls 10 of the drive pinion 2 and the sealing strips 17 on the radial end faces 15 of the wings 9 of the winged wheel 7 form respective multi-piece sealing cages 24, 34. The drawings clearly show that two sealing strips 13 are arranged next to each other in retaining grooves 12 on the radial end face 11 of each limiting wall 10 of the drive pinion 2 and that each sealing strip 13 of a limiting wall 10 is connected to a sealing strip 13 of an adjacent limiting wall 10 by radial and coaxial struts on the axial end surfaces 20, 21 of the drive pinion 2 to form a sealing cage element 25 of a first sealing cage 24 which is assembled out of three such sealing cage elements 25. At the same time, each sealing strip 17 on the radial end faces 15 of the wings 9 of the winged wheel 7 is connected by radial struts to annular segments 32, 33 bearing concentrically against the wheel hub 8 on both axial end surfaces 22, 23 of the winged wheel 7 to form a second sealing cage 34 which, again, is divided into two axially separated sealing cage elements 35, 36. In this embodiment, too, the radial struts of the sealing strips 17 to the annular segments 32, 33 of the sealing cage 34 are bent into a bow shape in one peripheral direction, and the free ends of the sealing cage elements 35, 36 are arranged in overlapping relationship in the retaining grooves 16 of the sealing strips 17 on the radial end faces 15 of the wings 9 of the winged wheel 7.

The drawings finally also show that all the cages 24, 26, 34 of the device 1 can be fixed in reception grooves 37 provided either in the axial end surfaces 20, 21 of the drive pinion 2 as shown in FIGS. 1 and 2 in the case of the sealing cage elements 25 of the sealing cage 24, or in the axial end surfaces 22, 23 of the winged wheel 7 as shown in FIGS. 4 and 7 in the case of the sealing cage elements 27 and 35, 36 of the sealing cages 26 and 34 respectively. These reception grooves 37 open into the retaining grooves 12, 16 of the sealing strips 13, 17 on the radial end faces 11, 15 of the limiting walls 10 of the drive pinion 2 and of the wings 9 of the winged wheel 7 respectively. In the embodiment of the invention shown in FIGS. 9 and 10, these reception grooves 37 are provided both in the axial end surfaces 20, 21 of the drive pinion 2 and in the axial end surfaces 22, 23 of the winged wheel 7 and open at one end into the retaining grooves 12 of the sealing strips 13 on the radial end faces 11 of the limiting walls 10 and at the other end, into the retaining grooves 16 of the sealing strips 17 on the radial end faces 15 of the wings 9 of the winged wheel 7.

The straight-hatched representation of the cages 24, 26, 34 in all the figures is meant to indicate that these cages 24, 26, 34 of the device 1 are made of spring sheet metal which has a wavy cross-sectional profile along its longitudinal axis so that it can be pressed by the pressure of the hydraulic pressure medium or by a biasing force produced during the assembly of the device 1 against the respective surface to be sealed.

What is claimed is:

1. A device for varying valve timing of gas exchange valves of an internal combustion engine, particularly a vane-type camshaft adjusting device comprising:

a drive pinion configured as an outer rotor and connected in driving relationship to a crankshaft of the internal combustion engine by a traction means, said drive pinion having a hollow space defined by a circumferential wall and two side walls, a winged wheel configured as an inner rotor and connected rotationally fast to a camshaft of the internal combustion engine, which winged wheel is inserted into the hollow space of the drive pinion and has a wheel hub on whose periphery are radially arranged at least two wings, at least two working chambers defined within the hollow space of the drive pinion by limiting walls extending from an inner surface of the circumferential wall towards a central longitudinal axis of the drive pinion, radial end faces of the limiting walls being in sealing contact with the wheel hub of the winged wheel by sealing strips arranged in axial retaining grooves, each working chamber being divided into two hydraulic pressure chambers by one of the wings of the winged wheel, radial end faces of the wings being in sealing contact in each working chamber with the inner surface of circumferential wall by sealing strips likewise arranged in axial retaining grooves, a turning and/or fixing of the winged wheel relative to the drive pinion, and thus a relative rotation and/or a continuous hydraulic clamping of the camshaft relative to the crankshaft is obtained by an optional successive or simultaneous pressurizing of the pressure chambers by a hydraulic pressure medium, wherein the sealing strips on the radial end faces of the limiting walls of the drive pinion and/or the sealing strips on the radial end faces of the wings of the winged wheels are joined to each other by radial and coaxial struts on axial end surfaces of the drive pinion and/or on axial end surfaces of the winged wheel to form a one-piece or a multi-piece sealing cage which enables a sealing of the hydraulic pressure chambers in the hollow space of the drive pinion from one another both radially on the circumferential wall of the drive pinion and/or on the wheel hub of the winged wheel, as also axially on the side walls of the drive pinion, the sealing cage further enabling a compensation of axial manufacturing tolerances between the drive pinion and the winged wheel of the device.

2. A device of claim 1 wherein the pressure chambers in the hollow space of the drive pinion are sealed radially on the circumferential wall of the drive pinion by the sealing strips on the radial end faces of the wings of the winged wheel, and for sealing the pressure chambers radially on the wheel hub of the winged wheel and axially on the side walls of the drive pinion, only the sealing strips on the radial end faces of the limiting walls of the drive pinion are joined to one another to form a one-piece or a multi-piece sealing cage.

3. A device of claim 2 wherein each limiting wall of the drive pinion preferably comprises two sealing strips arranged next to each other in retaining grooves provided on the radial end faces of the limiting walls, and each sealing strip of each limiting wall is joined to a sealing strip of an adjacent limiting wall to form a sealing cage element which seals the pressure chambers of one of the working chambers of the drive pinion axially and radially, and forms a part of a sealing cage assembled out of a plurality of such sealing cage elements.

4. A device of claim 1 wherein the pressure chambers in the hollow space of the drive pinion are sealed radially on the wheel hub of the winged wheel by the sealing strips on the radial end faces of the limiting walls of the drive pinion, and for sealing the pressure chambers radially on the circumferential wall of the drive pinion and axially on the side walls of the drive pinion, only the sealing strips on the radial end faces of the wings of the winged wheel are joined together to form a one-piece or a multi-piece sealing cage.

5. A device of claim 4 wherein the wings of the winged wheels preferably comprise two sealing strips arranged next to each other in retaining grooves provided on the radial end faces of the wings, and each sealing strip of each wing is joined to a sealing strip of an adjacent wing to form a sealing cage element which seals one pressure chamber of each of two adjacent working chambers of the drive pinion axially and radially and forms a part of a sealing cage assembled out of a plurality of such sealing cage elements.

6. A device of claim 2 wherein the sealing cage elements are divided preferably into two axially separated sealing segments whose free ends are arranged in overlapping relationship in the retaining grooves of the sealing strips on the radial end faces of the limiting walls of the drive pinion or on the radial end faces of the wings of the winged wheel respectively.

7. A device of claim 4 wherein the sealing strips on the radial end faces of the wings of the winged wheel are connected by radial struts to annular segments which bear concentrically against the wheel hub on the two axial end surfaces of the winged wheel so that a sealing cage is formed which is preferably divided into two axially separated sealing cage elements and simultaneously seals all the pressure chambers of the working chambers of the drive pinion axially and radially from one another in pairs.

8. A device of claim 1 wherein the limiting walls of the drive pinion comprise on their radial end faces preferably two sealing strips arranged next to each other in retaining grooves, and each sealing strip of each limiting wall is connected to a sealing strip of an adjacent limiting wall to form a sealing cage element of a first multi-piece sealing cage assembled out of a plurality of such sealing cage elements, a second sealing cage is formed at the same time in that each sealing strip on the radial end faces of the wings of the winged wheel is connected by radial struts to annular segments which bear concentrically against the wheel hub on both axial end surfaces of the winged wheel, and said second sealing cage is preferably divided into two axially separated sealing cage elements.

9. A device of claim 7 wherein the radial struts of the sealing strips on the radial end faces of the wings of the winged wheel to the annular segments of the sealing cage are made preferably arcuate in shape in one peripheral direction, and free ends of the sealing cage elements are arranged in overlapping relationship in the retaining grooves of the sealing strips on the radial end faces of the wings of the winged wheel.

10. A device of claim 1 wherein every sealing cage of the device is adapted to be fixed in reception grooves provided in the axial end surfaces of the drive pinion and/or in the axial end surfaces of the winged wheel, which reception grooves open into the retaining grooves of the sealing strips on the radial end faces of the limiting walls of the drive pinion and/or on the radial end faces of the wings of the winged wheel.

11. A device of claim 1 wherein the sealing cages of the device are made of spring sheet metal having a wavy longitudinal profile.

12. A device of claim 1 wherein the sealing cages of the device are made out of a material chosen from the group consisting of elastomers, teflon strip, copper wire and copper tube, which material is elastically or plastically deformable under the pressure of the hydraulic pressure medium and/or during the mounting of the device and has favorable tribological properties.

* * * * *